US005385121A

United States Patent [19]

Feiss

[11] Patent Number: 5,385,121

[45] Date of Patent: Jan. 31, 1995

[54] STEAM DESUPERHEATER

[75] Inventor: Roy L. Feiss, Southampton, Pa.

[73] Assignee: Keystone International Holdings Corp., Wilmington, Del.

[21] Appl. No.: 5,795

[22] Filed: Jan. 19, 1993

[51] Int. Cl.[6] ..... F04F 5/46; G21C 17/028

[52] U.S. Cl. ..... 122/459; 261/DIG. 13

[58] Field of Search ..... 122/459; 261/DIG. 13

[56] References Cited

U.S. PATENT DOCUMENTS

| | | | |
|---|---|---|---|
| 869,454 | 10/1907 | Otis | 122/459 |
| 2,222,348 | 11/1940 | Gorrie | 261/DIG. 13 |
| 2,254,472 | 9/1941 | Dahl | 261/DIG. 13 |
| 2,413,717 | 1/1947 | Kerr | 122/459 |
| 2,725,221 | 11/1955 | Pontow | 261/DIG. 13 |
| 3,392,712 | 7/1968 | Lustenader et al. | 122/459 |
| 3,719,524 | 3/1973 | Ripley et al. | 261/DIG. 13 |

*Primary Examiner*—Henry A. Bennet
*Assistant Examiner*—William C. Doerrler
*Attorney, Agent, or Firm*—John W. Logan, Jr.; Gary A. Hecht

[57] ABSTRACT

A desuperheater is disclosed which employs an acceleration orifice within a steam conduit to increase the velocity of steam flowing therethrough, creating a region of low pressure steam. A nozzle having an enclosed elliptical discharge orifice sprays small droplets of cooling water in a semi-elliptical hollow cone pattern directly into the region of low pressure steam flow. Evaporization of the cooling water into the steam is optimized allowing effective control of the steam temperature. Nozzle fouling and plugging is reduced because the droplet size created by the nozzle is small in comparison to the nozzle orifice.

20 Claims, 2 Drawing Sheets

STEAM DESUPERHEATER

BACKGROUND OF THE INVENTION

1. Field of the Invention

The present invention relates to steam desuperheaters and, more particularly, to desuperheaters directed to reducing steam temperature by spraying cooling water into a steam flow.

2. Description of the Prior Art

Steam desuperheaters are used for reducing and controlling the temperature of a steam flow. Many devices utilizing steam are designed to operate with a supply of steam at a specified temperature. Where the steam is produced at a temperature higher than that required, a desuperheater can lower the temperature by spraying cooling water into the steam flow upstream of the using device. Once sprayed into the steam flow, the cooling water evaporates, drawing energy from the steam and thereby lowering the steam temperature.

Previously, many conventional desuperheaters simply injected or used nozzles to spray water directly into a flow of steam within a conduit, such as a pipe. Although such devices have generally operated satisfactorily, many have suffered from the disadvantage that they provide insufficient control over the vaporization of the cooling water thereby making it difficult to effectively and accurately control the steam temperature. For example, injected cooling water that does not quickly evaporate may collect at the bottom of the steam pipe and evaporate therefrom in an uncontrolled manner, making precise control of the temperature impossible. Furthermore, unvaporized water can cause erosion and thermal stresses in the pipe, resulting in failure of the pipe conduit.

Various desuperheater designs have been developed to overcome these problems. Some use complex nozzle designs that spray a fine mist of relatively small water droplets. Such nozzles, however, rely on small holes or slots to create the small water droplets and may be prone to fouling or plugging from impurities within the cooling water. Additionally, complex nozzles can be expensive, both to manufacture and to install, with additional costs for individual water supply lines, connections for each nozzle, and labor to install.

Other desuperheater designs attempt to angle the nozzles so as to avoid impinging the walls of the pipe with the spray of cooling water. Such angled nozzle construction may be complex and expensive to manufacture while often being less than fully effective.

Moreover, current desuperheater designs, because of their complexity, must be manufactured to the specification of each individual use, further adding to the costs. Such devices can not easily be customized to meet particular requirements.

In view of the foregoing, it is the object of the present invention to provide a steam desuperheater that more effectively controls the steam temperature in a steam conduit.

Another object is to provide a steam desuperheater nozzle for spraying small water droplets of cooling water into the steam flow in a spray pattern allowing the water to evaporate more effectively.

A further object of the invention is to provide a desuperheater that is less expensive to manufacture and is easily customized for each individual use.

Another object of the invention is to alter the velocity of the steam in the region where cooling water is injected into the steam conduit to permit more effective vaporization of the cooling water.

Still another object is to provide a desuperheater with nozzles that are less prone to fouling or plugging.

Yet another object is to provide a desuperheater with built in nozzle redundancy so that the desuperheater will continue to operate where one of the nozzles becomes inoperative.

A still further object of the invention is to optimize desuperheater performance by allowing proper selection of the number and location of nozzles.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects are attained by providing a steam desuperheater comprising a steam inlet, a steam outlet, a passage connecting the inlet to the outlet, an acceleration orifice, and a nozzle for spraying cooling water into the steam flow. The acceleration orifice restricts the passage wherethrough the steam flows thereby increasing the velocity of the steam flow and creating a region of turbulent low pressure steam. The nozzle has an inclined elliptical discharge orifice for spraying small droplets of cooling water in a semi-elliptical hollow cone pattern providing optimum dispersion of the water into the region of low pressure steam flow. The droplet size created by the nozzle is relatively small compared to the nozzle orifice, making the nozzle far less prone to plugging and fouling.

The nozzle can be formed in the acceleration orifice which is thereafter inserted into the passage. This allows easy customization of the desuperheater for particular requirements by selecting the appropriate number and location of nozzles.

BRIEF DESCRIPTION OF THE DRAWINGS

The foregoing summary, as Well as the following detailed description will be better understood when read in conjunction with the figures appended hereto. For the purpose of illustrating the invention, there is shown in the drawings an embodiment which is presently preferred, it being understood, however, that this invention is not limited to the precise arrangement and instrumentalities shown.

DETAILED DESCRIPTION OF THE INVENTION

Figure 1:
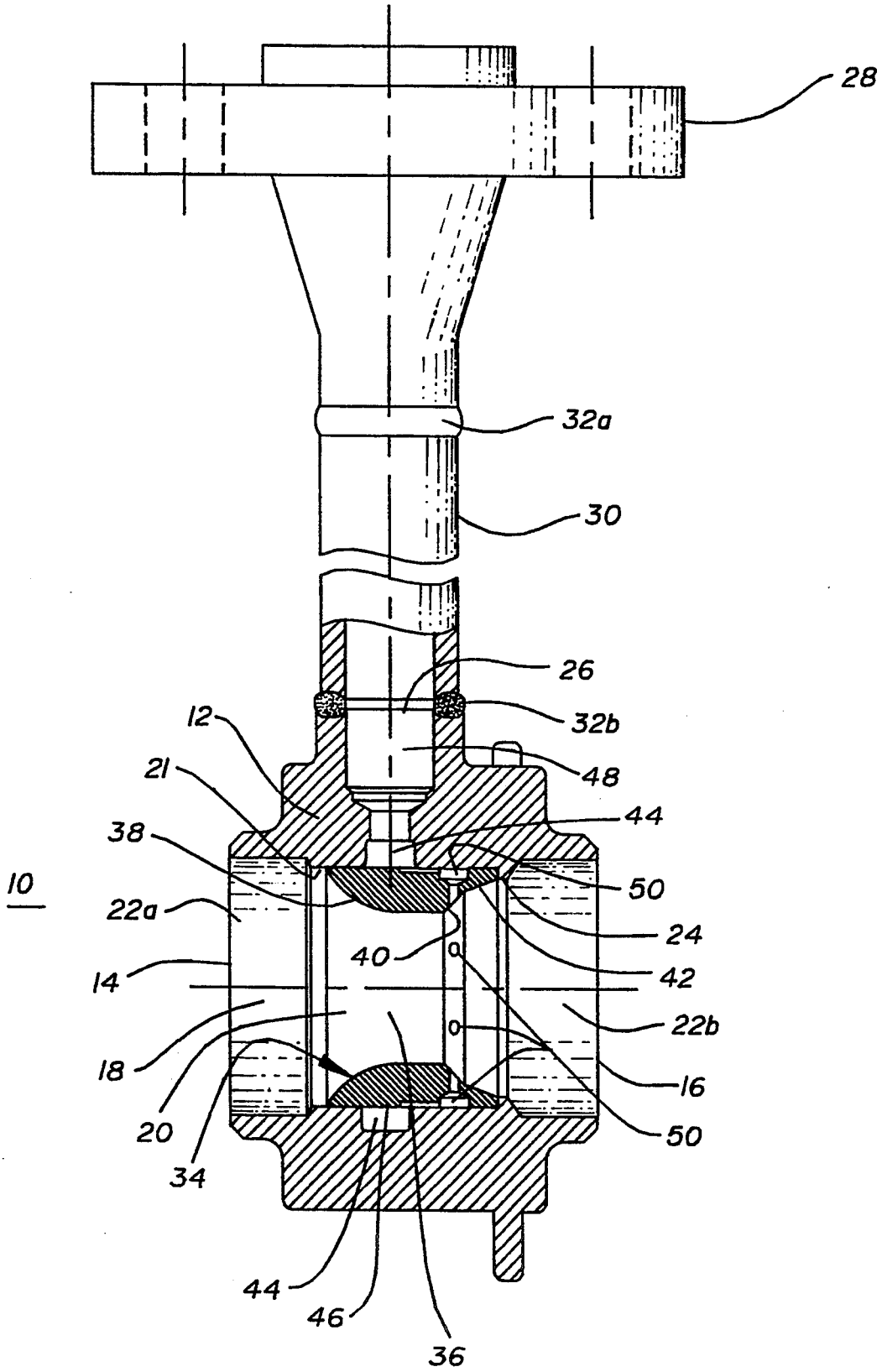
FIG. 1 is a sectional view of a desuperheater in accordance with the invention.

Referring to FIG. 1, there is illustrated a desuperheater 10 comprising a body 12 and having a circular steam inlet 14, a circular steam outlet 16, and a cylindrical passage 18 formed in the body 12 connecting inlet 14 to outlet 16. Passage 18 has a stepped area 20 defined by stepped wall 21 of body 12 and having a smaller internal diameter than adjacent inlet and outlet passages 22*a* and 22*b*, respectively, and a rim 24 formed as part of body 12 and running circumferentially around the inside wall of passage 18.

Desuperheater 10 may be installed in any known manner in a steam conduit, including upstream of any steam using device (not shown). When installed, steam from a steam generator enters through inlet 14 and exits through outlet 16. Body 12 as shown is machined for buttweld connections though any suitable pipe connection may be used, such as flangeless (between flange) installation.

Cooling water enters through circular water inlet 26 connected to a high pressure water source by flange 28 and pipe member 30 attached with welds 32*a*, 32*b*.

A cylindrical acceleration orifice insert 34 is located axially within stepped area 20 and abutting rim 24. It is retained in location and sealed within passage 18 by an interference (shrink) fit between the internal diameter of body 12 defined by stepped wall 21 and the outer diameter of the insert 34 itself. The interference seals between the insert 34 and the body 12 and maintains a stress loading in the insert 34 and the body 12 within the elastic limit of the materials used at the temperature variations encountered during service. The insert 34 is preferably made from a corrosion resistant heat treated material.

The inside diameter of acceleration orifice insert 34 defines a cylindrical steam flow passage 36 having a curvelinear wall 38 restricting the diameter of the steam passage and defining a restricted area, and inclined walls 40 and 42 sharply enlarging the diameter of the steam flow passage downstream the restricted area.

An annular cooling water channel 44 is formed in the body 12 circumferentially around the inside wall defining stepped area 20 and is bounded on its innermost side by the outer wall 46 of insert 34. Connecting the water inlet 26 to water channel 44 is a water passage 48 formed within the body 12.

Figure 2:
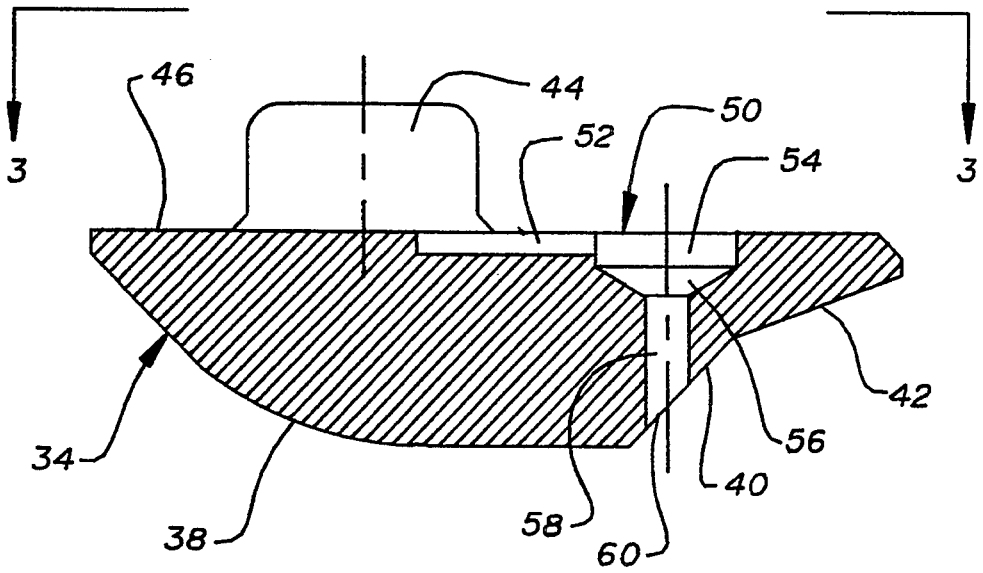
FIG. 2 is an enlarged sectional view showing a nozzle found in the acceleration orifice.
Figure 3:
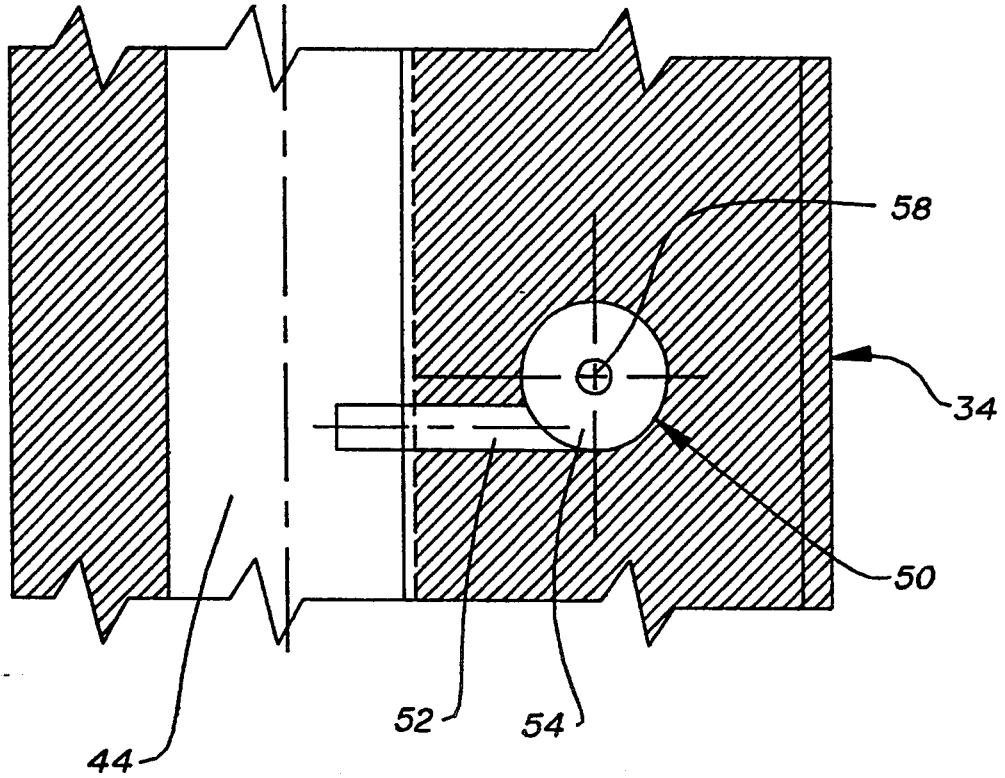
FIG. 3 is a sectional view along line 3—3 of FIG. 2.

Formed or machined into insert 34 are vortex nozzles 50. Referring to FIGS. 1, 2 and 3, vortex nozzles 50 each comprise a water supply tube 52 tangentially connected to a cylindrical swirl chamber 54 having a conical portion 56, a cylindrical throat 58, and an inclined elliptical discharge orifice 60 in the surface of angled wall 40 of the inside diameter of insert 34. Water supply tube 52 extends to water channel 44 for supplying cooling water to vortex nozzles 50 for spraying through discharge orifice 60 into the steam flow passage 36. Referring to FIG. 1, it is seen that the inside diameter wall 21 of body 12 (stepped area 20) defines a wall of the tube 52 and the chamber 54.

Nozzles are added simply by forming or machining the desired number of them into the insert 34 as described above before installing the insert into passage 18. Because the channel 44 runs circumferentially around the stepped area 20, each nozzle supply tube 52 connects to water channel 44 upon the installation of insert 34 into body 12.

Having described the structural aspects of desuperheater 10, its operation will now be discussed. Superheated steam enters desuperheater 10 through inlet 14. As the steam flows through the restricted steam flow passage defined by the inner diameter 38 of insert 34, the velocity of the steam increases, creating a zone of high velocity, low pressure steam, defined by walls 40 and 42 and passage area 22*b*, into which the cooling water is sprayed.

Cooling water enters desuperheater 10 through water inlet 26 into water channel 44 and thereafter into each water tube 52 of each nozzle 50. During its residence time inside the water channel 44, the cooling water is preheated with heat energy transferred from the steam and conducted through body 12 and insert 34.

As best seen in FIGS. 2 and 3, once in a water tube 52, the cooling water tangentially enters swirl chamber 54 where a portion of the pressure energy of the water is converted to velocity energy. This conversion develops a high velocity water swirl within the chamber 54 which accelerates downward and inward in the conical portion 56 before entering the low pressure region of the stream flow through cylindrical throat 58 and inclined elliptical discharge orifice 60. The spray pattern developed by the cooling water exiting through discharge orifice 60 is a small droplet semi-elliptical hollow cone pattern providing optimum dispersion in the superheated steam.

The droplet size range, hollow spray pattern, and spray direction is established by the geometry of the swirl chamber 54, diameter of throat 58, and the exit shape created by the surfaces of intersection of the nozzle throat 58 and the acceleration orifice 34 defining the inclined elliptical discharge orifice 60. The hollow cone spray pattern developed by each nozzle is semi-elliptical in shape, with the lesser number of water droplets entering the steam flow perpendicular to the direction of flow, and the larger number entering as a wide fan shaped hollow cone with a velocity component in the direction of steam flow. Because the larger number of droplets are sprayed in the same direction as the steam flow, droplet residence time in the superheated steam zone is increased, thereby improving evaporation.

The steam temperature is reduced as the droplets evaporate into the steam flow. The reduced temperature steam is then delivered to the using device.

The configuration of the individual vortex nozzles 50 provides large flow passages in proportion to the size of the droplets produced. The nozzle design as described is therefore less prone to fouling or plugging than conventional nozzles that rely on small holes or slots for generating a small water droplet spray.

Multiple vortex nozzles 50 can be placed circumferentially around the steam acceleration orifice 34 as shown, where the combination of small droplet size and proper distribution by the elliptical hollow cone spray pattern will effectively deliver cooling water into superheated steam. Desuperheater optimization is done by selecting the appropriate number and location of nozzles to meet the specific steam flow requirements.

While a preferred embodiment of the invention has been described herein, it should be apparent to one skilled in the art that various changes and modifications can be made without departing from the true spirit and scope of the invention as recited in the appended claims.

I claim:

1. A devise for desuperheating steam, comprising:

a steam inlet;

a steam outlet;

a passage connecting said inlet to said outlet;

an acceleration orifice for creating a region of accelerated low pressure steam within said passage; and nozzle means for spraying cooling water into said region of accelerated low pressure steam, said nozzle means comprising an inclined elliptical discharge orifice positioned in said acceleration orifice.

2. A device for desuperheating steam according to claim 1 wherein said nozzle means further comprises a swirl chamber.

3. A device for desuperheating steam according to claim 1 wherein said acceleration orifice comprises an insert fitted within said passage.

4. A device for desuperheating steam according to claim 3 wherein said nozzle means is formed in said insert.

5. A device for desuperheating steam according to claim 1 further comprising a water channel within the device supplying cooling water to said nozzle means.

6. A device for desuperheating steam according to claim 3 wherein said insert is retained in location within said passage by an interference shrink fit.

7. A steam desuperheater comprising:

a body having an inlet, an outlet, and a passage connecting said inlet to said outlet;

an acceleration orifice within said passage; and nozzle means, formed within said acceleration orifice, for spraying cooling water into said passage downstream said acceleration orifice, said nozzle means comprising an elliptical discharge orifice.

8. A steam desuperheater according to claim 7 wherein said nozzle means comprises a swirl chamber.

9. A steam desuperheater according to claim 7 wherein said acceleration orifice comprises an insert fitted within said passage.

10. A steam desuperheater according to claim 7 further comprising a swirl chamber and a water supply tube tangentially connected to said swirl chamber.

11. A steam desuperheater according to claim 7 further comprising a water channel within the desuperheater communicating with and supplying cooling water to said nozzle means.

12. A steam desuperheater according to claim 11 wherein said channel is formed in said body.

13. A steam desuperheater according to claim 12 wherein said channel is partially bounded by the said insert.

14. A device for desuperheating steam according to claim 1 wherein said acceleration orifice comprises a curvelinear wall defining a restricted area for accelerating the steam flow, and an inclined wall for defining a sharply enlarged area of the steam flow passage downstream said restricted area, said nozzle means disposed to spray water into the sharply enlarged area.

15. A device for desuperheating steam according to claim 14 wherein said nozzle means further comprises a swirl chamber.

16. A desuperheater, comprising:

a desuperheater body having a steam inlet and a steam outlet;

a passage formed within said body connecting said inlet to said outlet;

an acceleration orifice having a curvelinear wall defining a restricted passage area to create a region of accelerated low pressure steam, and having an inclined wall defining a sharply enlarged area of the steam passage downstream said restricted passage area; and a water spray nozzle positioned in said sharp enlargement of said acceleration orifice.

17. A desuperheater in accordance with claim 16 wherein said spray nozzle has an elliptical discharge orifice.

18. A desuperheater in accordance with claim 17 wherein said spray nozzle has a swirl chamber.

19. A desuperheater in accordance with claim 18 wherein said acceleration orifice comprises an insert fitted within said desuperheater body.

20. A desuperheater in accordance with claim 17 wherein said spray nozzles are formed in said acceleration orifice.

* * * * *